United States Patent [19]

Neward

[11] Patent Number: 4,979,883

[45] Date of Patent: Dec. 25, 1990

[54] VACUUM LIMITER FOR PUMP

[76] Inventor: Theodore C. Neward, P.O. Box 725, Cucamonga, Calif. 91730

[21] Appl. No.: 413,181

[22] Filed: Sep. 27, 1989

[51] Int. Cl.[5] ..... F04B 37/14

[52] U.S. Cl. ..... 417/441; 137/114; 137/907

[58] Field of Search ..... 417/441, 440; 137/907, 137/512.3, 526, 114

[56] References Cited

U.S. PATENT DOCUMENTS

| | | | |
|---|---|---|---|
| 2,217,056 | 10/1940 | Johnson | 137/526 |
| 3,612,722 | 10/1971 | Neward | 417/566 X |
| 4,413,644 | 11/1983 | Woodward | 137/907 X |
| 4,502,502 | 3/1985 | Krug | 137/526 X |
| 4,565,506 | 1/1986 | Williams | 417/440 |
| 4,758,224 | 7/1988 | Siposs | 137/512.3 X |
| 4,775,302 | 10/1988 | Neward | 417/440 |
| 4,806,084 | 2/1989 | Neward | 417/440 |

FOREIGN PATENT DOCUMENTS 518592 5/1929 Fed. Rep. of Germany ... 137/512.3

*Primary Examiner*—Stephen M. Hepperle
*Attorney, Agent, or Firm*—Lyon & Lyon

[57] ABSTRACT

There is disclosed herein a small and compact vacuum pump which serves as a portable vacuum source. The pump basically includes a cylinder coupled with a handle, and a piston in the cylinder coupled with another handle, along with a suitable valving assembly for allowing a vacuum to be drawn at an inlet of the pump. More particularly, there is also disclosed a vacuum limiter which can be attached to or form an integral part of the pump. The vacuum limiter includes an assembly having a pair of valves one of which is adjustable for allowing the limit vacuum to be set. The adjustable valve is a metering check valve and the second valve is a holding check valve upstream of the first.

15 Claims, 1 Drawing Sheet

VACUUM LIMITER FOR PUMP

BACKGROUND OF THE INVENTION

The present invention relates to the field of hand-held vacuum pumps, particularly of the type disclosed in U.S. Pat. Nos. 3,612,722, 4,775,302 and 4,806,084, by the present inventor Theodore C. Neward, the disclosures of which are incorporated herein by reference.

Vacuum pumps are generally useful whenever a vacuum is desired, for example, to provide suction. Many types of vacuum pumps have been devised, but they often suffer from such drawbacks as complexity, expense, excessive bulk, inability to pull a suitable vacuum, and the like. The vacuum pump of the aforesaid patents has significantly solved the need for a vacuum pump which is simple, inexpensive, lightweight, compact and portable, and one which can pull a useful vacuum.

Such hand-held vacuum pumps are particularly useful in various industries, such as the automotive industry for vacuum system testing and repair, liquid sampling and the like. In the medical field, for example, such pumps have been used with vacuum extraction devices in childbirth, an aid for testing for throat blocking of choking victims, and other uses. Vacuum pumps manufactured according to the aforesaid patents have the ability to pull a vacuum of, for example, twenty-eight inches of mercury.

In some applications for such vacuum pumps, it is particularly desirable to pull a preset or controlled vacuum, and one which is repeatable. Inasmuch as the hand-held vacuum pump is manually operated by hand and because the pump can quickly pull a relatively high vacuum, it is difficult to manually pull a given level of vacuum.

SUMMARY OF THE INVENTION

The present invention provides an improvement on the aforesaid vacuum pumps by enabling a preset vacuum to be obtained in a simple manner, and lends the pump to a wider range of potential uses.

The present invention comprises a vacuum limiter including a simple adapter which can be attached to a vacuum pump of the aforesaid type. The vacuum limiter includes a first valve serving as a metering check valve and which can be selectively adjustable and set at the time of manufacture, or can be user adjustable. A second valve is provided upstream of the first valve and functions as a holding check valve for holding the vacuum drawn as the metering check valve is opened. The metered vacuum is available upstream of the holding check valve. The vacuum limiter is relatively simple and comprises few parts and, thus, is easy to manufacture and assemble, and is readily connectable with the vacuum outlet of a hand-held vacuum pump of the type shown in the aforesaid patents.

Accordingly, it is an object of the present invention to provide an improved hand-held vacuum pump.

Another object of this invention is to provide a vacuum limiter for a hand-held vacuum pump.

A further object of this invention is to provide a vacuum limiter which can be used for retrofitting or attachment to a hand-held vacuum pump.

BRIEF DESCRIPTION OF THE DRAWINGS

These and other objects of the present invention will become better understood through a consideration of the following description taken in conjunction with the drawings in which.

DETAILED DESCRIPTION OF THE INVENTION

Figure 1:
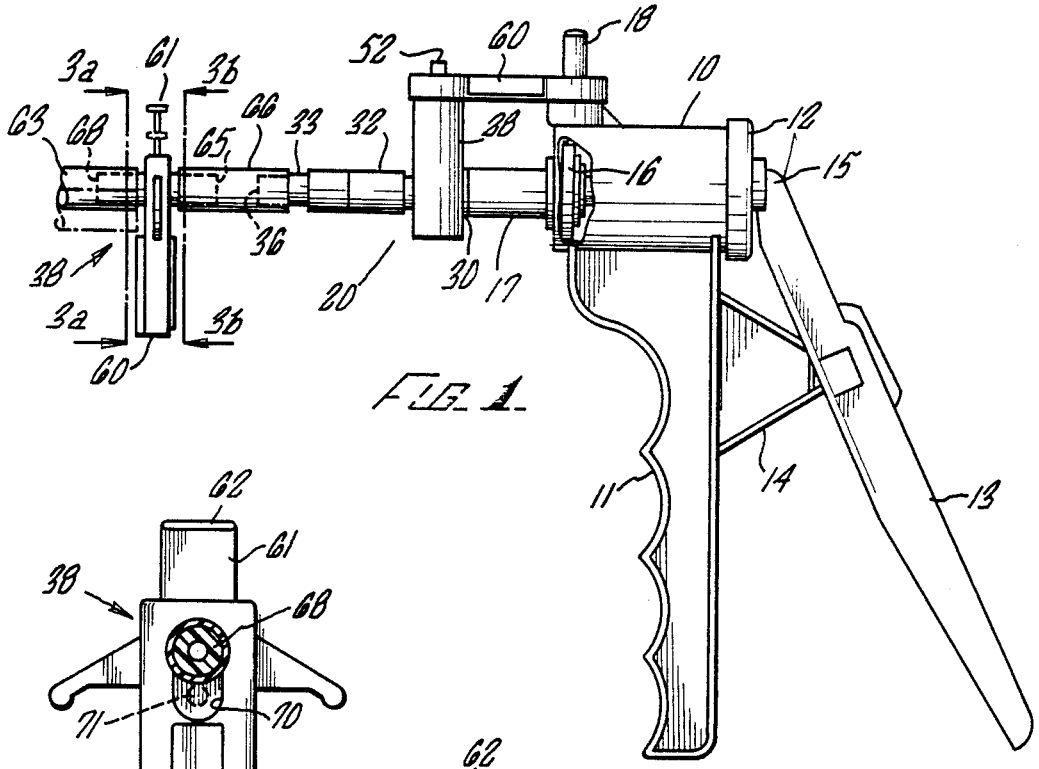
FIG. 1 is a side view showing a hand-held vacuum pump of the type shown and described in said aforesaid patents, and with a vacuum limiter according to the present invention coupled therewith.

Turning now to the drawings, a pump of the type disclosed in the aforesaid patents is shown which includes a cylinder 10 connected to a first fixed handle 11. The cylinder 10 includes a cap 12 covering one end thereof, and a second movable handle 13 is pivoted on a support 14 attached to the handle 11. The handle 11 has its upper end 15 connected to a piston 16 within the cylinder 10. The cylinder 10 has an inlet 17 and exhaust port 18 connected to the opposite end of the cylinder 10 from the cap 12, and includes suitable valves (not shown) for allowing a vacuum to be drawn.

The pump so far described is virtually identical to that disclosed in U.S. Pat. No. 4,806,084, but without a vacuum release mechanism shown in that patent. The vacuum limiter of the present invention is substituted for that vacuum release mechanism. As will be apparent to those skilled in the art, squeezing the handles 11 and 13 together causes the piston 16 to be reciprocated back and forth in the cylinder 10 under spring tension as more fully described in U.S. Pat. No. 4,806,084, and the other patents, thereby causing a vacuum to be normally drawn at the inlet port 17. In doing this air is drawn through the port 17 into the cylinder 10 by retraction of the piston as the handles 11 and 13 move together, and air is exhausted from the cylinder through the exhaust outlet 18 as the piston 16 returns toward the outlet 18 as is more fully described in the aforesaid patents.

In accordance with the present invention, a vacuum limiter 20 is provided which allows a preset vacuum to be drawn by the pump assembly of FIG. 1 to provide a metered vacuum at vacuum port 36. A vacuum release 38, which will be described later, preferably is connected between the port 36 and the item to be evacuated (not shown) so as to enable quick and easy release of the vacuum.

Since the present pump is a vacuum pump, when drawing a vacuum air enters port 36 and flows through valve 24 and valve 22. Therefore, the port 36 is an upstream end of the pump and end 30 is a downstream end. Thus, the vacuum limiter 20 includes a first metering check valve 22 in a downstream chamber 23 and a second holding check valve 24 upstream of the valve 22 and in an upstream chamber 25, both check valve 24 and chamber 25 being upstream of the valve 22. The limiter 20 includes a generally cross shaped housing or body 28 formed of plastic with the downstream and upstream chambers 23 and 25 therein, and having a first downstream end 30 for attachment to the inlet port 17 of the cylinder 10 of the pump shown in FIG. 1, and a second upstream end 31. The latter end 31 is attached to a first cylindrical member 32 which contains the holding valve 24. A second cylindrical member 33 is attached to the member 32 and provides the metered vacuum port 36.

Figure 2:
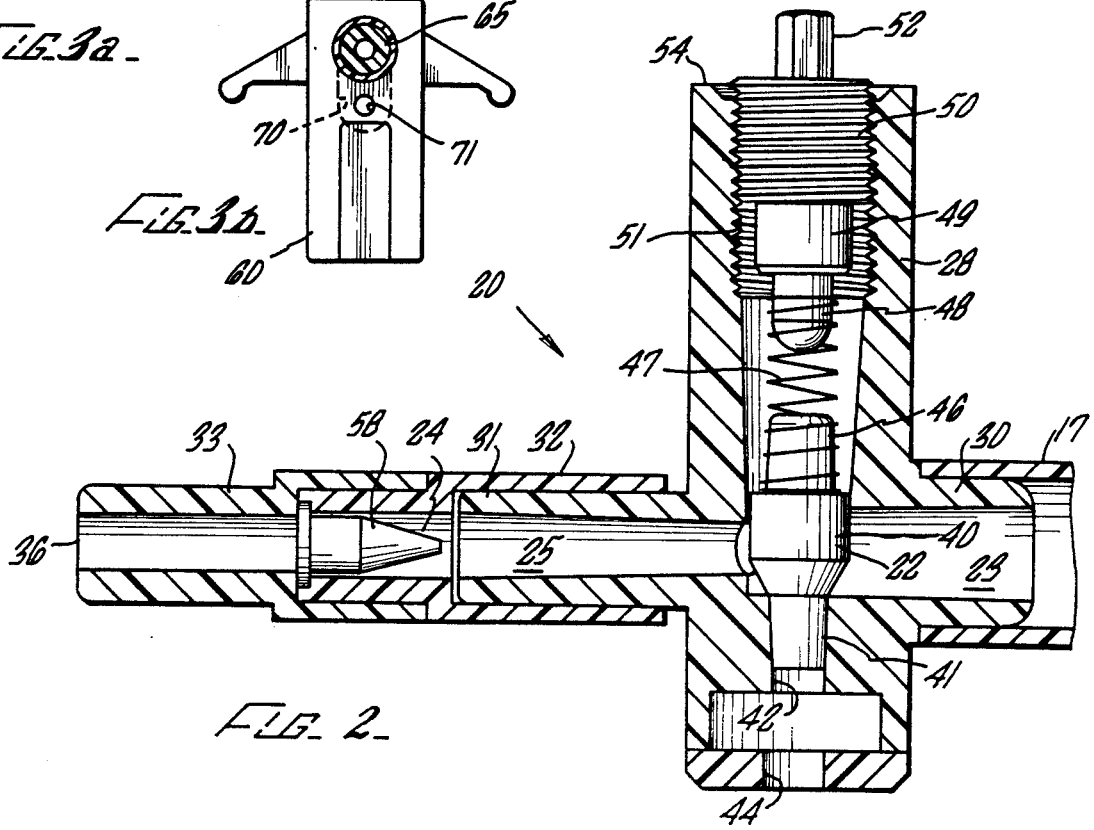
FIG. 2 is a detailed cross-sectional view of the vacuum limiter of FIG. 1.

The metering check valve 22 comprises a plunger 40 having a plug 41 at the lower end thereof which mates and seals with a circular channel 42 forming a valve seat in the lower end of the housing 28. The plug 41 is essentially frusto-conical in shape and has a slight draft or shallow draft angle (the apex of which would exist below the drawing of FIG. 2), and the wall of the circular channel 42 has a similar mating angle. The channel 42 intersects and is in fluid communication with the chamber 23. An opening 44 is provided at bottom of the housing 28 through which air can enter as the plug 41 of the plunger 40 moves upward in the circular channel 42 as the pump is operated to draw a vacuum through port 17. The upper end of the plunger 40 is essentially in the shape of a cylindrical finger 46 for mating with the lower end of a compression spring 47. The compression spring 47, as will be apparent to those skilled in the art, preloads the plunger 40 and normally retains the plug 41 sealed in the circular channel 42. The upper end of the spring 47 is coupled with a lower projection 48 of an adjusting plug 49. The adjusting plug 49 has external threads 50 mating with internal threads 51 of the housing 28, and has a suitable wrench or screwdriver fitting 52 at the top thereof to allow the same to be screwed up or down so as to adjust the force applied to the plunger 40 via the spring 47, and thus adjust the maximum level of vacuum that can be drawn through the limiter. Although the fitting 52 can be provided, in many instances it is desirable to preset the vacuum level at the time of manufacture as by screwing the plug 49 to the appropriate position or otherwise setting its location, and then sealing the upper end 54 of the housing 28 so that the preset adjustment cannot be tampered with.

As will be apparent to those skilled in the art, as the handles 11 and 13 of the pump of FIG. 1 are pressed together and released, air is drawn through the opening 44, through the circular channel 42 raising the plunger 40 against the pressure of the spring 47, into the downstream chamber 23, through pump port 17, and into the cylinder 10 and out the exhaust port 18. Because of the nature of drawing a vacuum, as contrasted to generating a pressure, the apparatus thus far described is not sufficient to hold a particular preset vacuum. This results because the spring 47 and plunger 40 cannot return fast enough to seal the circular channel 42 (even assuming that the upstream chamber 25 is closed or does not exist), although this arrangement would work for holding pressure. On the other hand, if the spring 47 is sufficiently stiff to quickly return the plunger 40 and close this metering valve for a vacuum seal, it will be too stiff for the pump to pull a meaningful vacuum.

Accordingly, a second, upstream holding check valve 24 is provided and which preferably comprises a duckbill valve 58 (which can be the same as duckbill valve 132 of FIG. 3 of U.S. Pat. No. 4,806,084). Thus, as the pump is operated, the pump causes reduced pressure in downstream chamber 23 causing the metering valve 22 to open, the metering valve 22 creates a vacuum in the downstream chamber 25, and the holding valve 24 holds or traps the vacuum while the plunger 40 returns to a sealing position with the valve seat 42. In this combination, it is important that the holding valve 24 have less restriction than the metering valve 22. Preferably, the restriction imparted by the holding valve 24 is considerably lighter or less than that of the metering valve 22. As will be apparent to those skilled in the art, it takes very little pressure at vacuum port 36 to open the duckbill valve 24, and the same can close quickly. It thus is desirable that the valve 24, be it a duckbill valve as described above or another form of check valve, have a minimum opening resistance as compared to the valve 22. The valve 24 could be a ball check valve as can be the metering valve 22, but still the valve 24 must provide considerably less opening resistance.

It has been found that this vacuum limiter as shown and described provides a very repeatable maximum level of vacuum that can be drawn with the hand-held vacuum pump. As the pump handles 11 and 13 are operated, the plunger 40 jumps up and down to allow the vacuum to be drawn, but a spring loaded plunger or ball check valve cannot close fast enough and sufficiently enough to hold the vacuum, such as ten to twenty-eight inches of mercury, as noted above. With only the metering valve 22, the vacuum level bounces up and down when pumping, and a preset vacuum limit cannot be reliably held. The use of the two valves, the metering valve 22 which is adjustable and the holding valve 24, in the particular sequence as shown and described for enabling a preset maximum vacuum to be drawn at the vacuum port 36, and wherein the holding valve is considerably lighter or has considerably less valve, is new and unique.

While in a vacuum system the spring 47 and plunger 40 cannot move back down fast enough to seal and hold the selected vacuum (although it would work for holding a pressure), the less resistive holding valve 24 opens and shuts immediately as the pump is operated and thus functions to hold the selected vacuum.

The housing 28 can be formed of PVC, as can the cylindrical members 32 and 33. The plunger 40 preferably is soft PVC. The compression spring 47 is any suitable compression spring which has a sufficient valve to obtain the desired maximum vacuum. The first end 30 of the body 28 can be secured to the inlet port 17 of the pump body by a suitable adhesive, such as a PVC adhesive. Similarly, the cylindrical member 32 can be secured to the upstream end 31 and the member 33 secured to the member 32 by such a suitable adhesive. The members 32 and 33 are separate parts so that the duckbill valve 58 can be assembled and then attached to end 31 of the housing 28. A plastic bracket 60 can be secured between the exhaust outlet 18 (or cylinder 10) and the limiter 20 body 28 if desired to provide better structural rigidity.

Figure 3A:
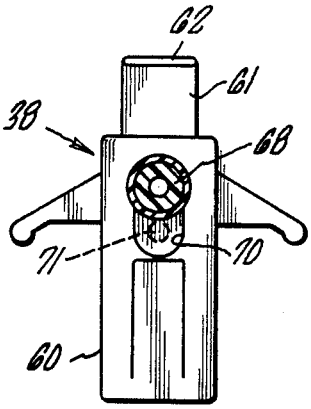
FIGS. 3*a* and 3*b* illustrate a vacuum release for use with the pump and limiter of the present invention.
Figure 3B:
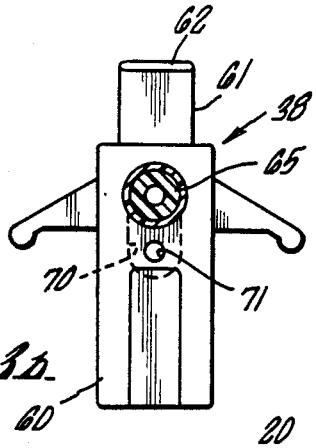

Turning again to the vacuum release 38, the same is essentially a conventional slide valve which has been used in the past with vacuum pumps of the nature shown in FIG. 1. The vacuum release 38 comprises a body 60 having a movable slide valve 61 therein which can be depressed at the top 62 and pushed downwardly against the force of an internal spring (not shown) to release the vacuum drawn from an item to be evacuated (not shown) connected to a tube 63. More particularly, the vacuum release has an outlet 65 which can be connected by a flexible tube 66 to the vacuum port 36 as seen in FIG. 1. The outlet 65 is formed integrally with the body 60 and communicates through a hole in the slide 61 with an inlet tube 68 formed integrally with the slide 61. The inlet tube 68 extends through an elongated slot 70 in the body 60 so as to enable the slide 61 and tube 68 to be moved downwardly as seen in FIG. 3*a* to release the vacuum. This action puts the inlet tube 68 in communication with an opening 71 in the body 60 as seen in FIG. 3*b* to allow air to flow through the opening 71 into the tube 68 and the tube 63 to the item which has been evacuated to thereby release the vacuum.

While embodiments of the present invention have been shown and described, various modifications may be made without departing from the scope of the present invention, and all such modifications and equivalents are intended to be covered.

What is claimed is:

1. A hand-held vacuum pump, comprising a cylinder for isolating a volume from the atmosphere and having an inlet port and an outlet port, biased piston means for drawing a vacuum through the inlet port of the cylinder and including a piston which can be moved in the cylinder, handle means coupled with the cylinder means and the piston means, and a vacuum limiter coupled with the inlet port for controlling the maximum vacuum to be drawn by said pump, said limiter including a first metering valve which is adjustable to set the maximum vacuum level and disposed upstream of the inlet port, and a second holding valve disposed upstream of the metering valve for holding the selected vacuum and for providing a metered vacuum port.

2. A pump as in claim 1 wherein the vacuum limiter has a substantially cross shaped body with horizontal and vertical arms and with the horizontal arm thereof forming a downstream chamber and an upstream chamber, with the downstream chamber being in fluid communication with the inlet port of the pump, said metering valve being disposed in the vertical arm of the body extending into the downstream chamber for sealing the same, and said holding valve being disposed adjacent said upstream chamber.

3. A pump as in claim 1 wherein said metering valve comprises a spring biased plunger and an adjusting plug is disposed in said body for biasing said plunger to its closed position in said first chamber.

4. A pump as in claim 3 wherein said plunger of said metering valve has a substantially frusto-conical shaped plug engaging an opening in the body forming a valve seat communicating with said first chamber.

5. A pump as in claim 4 wherein the holding valve is a duckbill valve.

6. A hand-held vacuum pump, comprising a cylinder for isolating a volume from the atmosphere and having an inlet port and an outlet port, biased piston means including a piston disposed in the cylinder for drawing a vacuum through the inlet port of the cylinder and including a piston which can be moved in the cylinder, handle means coupled with the cylinder means and the piston means, and a vacuum limiter coupled with the inlet port for controlling the maximum vacuum to be drawn by said pump, said limiter including a first metering valve which is adjustable to set the maximum vacuum level and disposed upstream of the inlet port, and a second holding valve disposed upstream of the metering valve for holding the selected vacuum and for providing a metered vacuum port, said metering valve comprising a spring biased plunger and an adjusting plug provided for biasing said plunger to a closed position, and the holding valve is a duckbill valve.

7. A pump as in claim 1 wherein the vacuum limiter has a substantially cross shaped body with horizontal and vertical arms and with the horizontal arm thereof forming an upstream chamber and a downstream chamber, with the downstream chamber being in fluid communication with the inlet port of the pump, said metering valve being disposed in the vertical arm of the body extending into the downstream chamber for sealing the same, and said holding valve being disposed adjacent said upstream chamber.

8. A pump as in claim 7 wherein said plunger of said metering valve has a substantially frusto-conical shaped plug engaging an opening in the body forming a valve seat communicating with said first chamber.

9. A pump as in claim 1 including a vacuum release connected to the metered vacuum port.

10. A vacuum limiter for use with a hand-held vacuum pump having a cylinder with an inlet port and an outlet port and a piston for drawing a vacuum through the inlet port of the cylinder as the piston is moved back and forth in the cylinder, comprising a body adapted to be coupled with the inlet port of the pump for controlling the maximum vacuum to be drawn by said pump, a first metering valve which is adjustable to set the maximum vacuum level being disposed upstream of the inlet port, and a second holding valve disposed upstream of the metering valve for holding the selected vacuum and for providing a metered vacuum port.

11. A vacuum limiter as in claim 10 wherein the body is substantially cross shaped with horizontal and vertical arms and with the horizontal arm thereof forming an upstream chamber and a downstream chamber, with the downstream chamber being adapted to be in fluid communication with the inlet port of the pump, said metering valve being disposed in the vertical arm of the body extending into the downstream chamber for sealing the same, and said holding valve being disposed adjacent said upstream chamber.

12. A pump as in claim 11 wherein said metering valve comprises a spring biased plunger and an adjusting plug is disposed in said body for biasing said plunger to its closed position in said first chamber.

13. A pump as in claim 12 wherein said plunger of said metering valve has a substantially frusto-conical shaped plug engaging an opening in the body forming a valve seat communicating with said first chamber.

14. A pump as in claim 13 wherein the holding valve is a duckbill valve.

15. A vacuum limiter for use with a hand-held vacuum pump having a cylinder with an inlet port and an outlet port and a piston for drawing a vacuum through the inlet port of the cylinder as the piston is moved back and forth in the cylinder, comprising a body adapted to be coupled with the inlet port of the pump for controlling the maximum vacuum to be drawn by said pump and having a first chamber to communicate with the inlet port, a first metering valve comprising a spring biased plunger and an adjusting plug disposed in said body for biasing said plunger to a closed position in said first chamber, said metering valve being adjustable to set the maximum vacuum level and being disposed in said first chamber and downstream of the inlet port, and a second holding valve disposed downstream of the metering valve for holding the selected vacuum and for providing a metered vacuum port.

* * * * *